United States Patent [19]

Alexander

[11] Patent Number: 4,547,857

[45] Date of Patent: Oct. 15, 1985

[54] APPARATUS AND METHOD FOR WAVE MOTION COMPENSATION AND HOIST CONTROL FOR MARINE WINCHES

[76] Inventor: George H. Alexander, 3114 Lazy Pine, LaPorte, Tex. 77571

[21] Appl. No.: 507,102

[22] Filed: Jun. 23, 1983

[51] Int. Cl.[4] ..... G06G 7/48

[52] U.S. Cl. ..... 364/505; 212/191; 254/900; 364/164; 364/174; 414/138

[58] Field of Search ..... 166/355; 212/190, 191; 254/270, 900; 364/164, 174, 463, 505; 414/137, 138, 139

[56] References Cited

U.S. PATENT DOCUMENTS

| | | | |
|---|---|---|---|
| 2,249,947 | 7/1941 | Doe | 254/900 X |
| 3,286,990 | 11/1966 | Weisenbach | 254/900 X |
| 3,624,783 | 11/1971 | Chang | 254/900 X |
| 3,753,552 | 8/1973 | Barron | 254/900 X |
| 4,098,082 | 7/1978 | Packer | 254/900 X |
| 4,121,293 | 10/1978 | Kerr et al. | 364/463 |
| 4,136,391 | 1/1979 | Eterno et al. | 364/463 X |
| 4,147,330 | 4/1979 | Eik | 414/137 X |
| 4,304,337 | 12/1981 | Dummer | 414/139 X |
| 4,324,385 | 4/1982 | Cojean et al. | 254/900 X |
| 4,349,179 | 9/1982 | Barber | 254/270 |
| 4,354,608 | 10/1982 | Wudtke | 212/190 X |
| 4,448,396 | 5/1984 | Delago | 414/138 X |

OTHER PUBLICATIONS

"Crane Control A Must In Restless North Sea", by R. A. Morley; Offshore; Feb. 1977.

*Primary Examiner*—Errol A. Krass
*Assistant Examiner*—Edward R. Cosimano
*Attorney, Agent, or Firm*—Arnold, White & Durkee

[57] ABSTRACT

A wave motion compensator for a marine winch, in which the tension on the winch rope is maintained substantially constant while the load on the rope moves relative to the winch. This constant tension is maintained by controlling the winch drive motor so that the movement of the winch rope matches the movement of the load without substantial lag. The control is provided by a computer which repeatedly monitors the movement of the winch rope and, by comparing this input data and standard sea state data, predicts the relative movement of the load and the winch at a time in advance of the time the prediction is made at least as long as the lag time of the winch system. The computer then issues appropriate commands to the winch drive motor controller. In marine applications involving the lifting or lowering of loads, the computer is also used to determine the optimum time for initiating lifting and completing lowering of the load, and to automatically perform these operations.

35 Claims, 6 Drawing Figures

Fig. 5
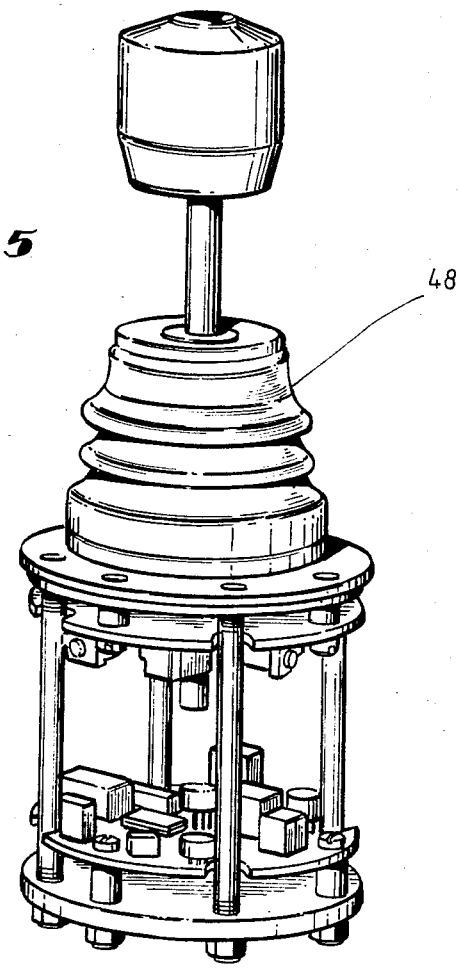
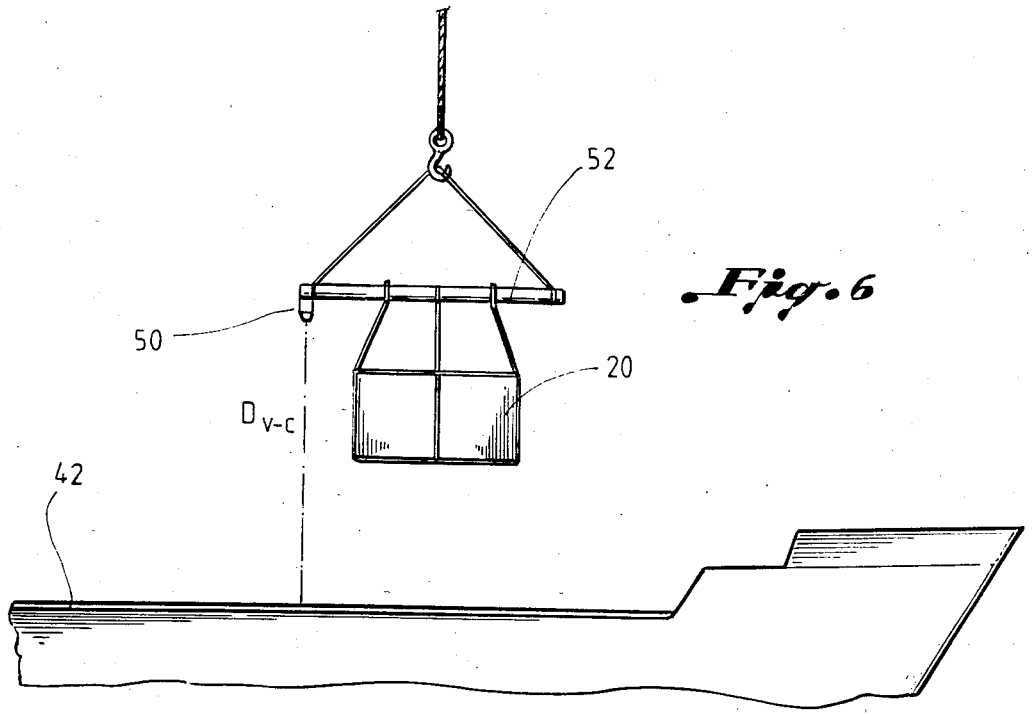
Fig. 6

APPARATUS AND METHOD FOR WAVE MOTION COMPENSATION AND HOIST CONTROL FOR MARINE WINCHES

BACKGROUND OF THE INVENTION

This invention relates to winches, in particular winches used in a marine environment. It provides a means for maintaining a substantially constant tension on the winch rope despite the fact that the load and the winch are moving relative to each other. It further provides a means for safely raising a load from, or lowering a load onto, a vessel moving on the sea surface relative to the crane which is raising or lowering the load.

There are a number of applications in which it is necessary or desirable to maintain a constant tension on a winch rope, despite the fact that the winch and the load are moving relative to each other. Examples are preventing shock loads on a marine crane when lifting is initiated, maintaining a constant pressure on a drill stem being operated from a floating rig and maintaining a steady tension on a marine anchor.

A number of servo-controlled systems intended to automatically operate the winch so as to follow the movement of the load and thereby maintain a constant tension are described in the prior art. Examples can be found in U.S. Pat. Nos. 2,249,947 and 3,753,552. However, all such mechanical or electro-mechanical control systems have an inherent lag between input of a command to alter the operation of the winch motor and the alteration actually occurring. This lag means that the tension cannot be maintained constant, particularly at a point where the relative direction of motion changes. The conventional response to this problem is to design the control system so as to have as small lag as possible under the circumstances. However, in the types of application described above, the winch loads are typically large, and to control such loads the winch motor and controller must be of a design that typically has a relatively long lag time.

Further problems are experienced in situations requiring the removal of loads from or the deposition of loads onto the surface of a vessel using a crane which is relatively stationary, particularly in heavy seas. However, it may be impossible in some circumstances to delay such operations until the sea is relatively calm. Examples of such situations are the supply of offshore drilling and production platforms, particularly in storm-prone areas such as the North Sea, and military operations.

The problems arise mainly because the vessel is rising and falling with the waves, and this can represent considerable vertical movement and acceleration of the vessel's surface relative to the crane which is to hoist the load from, or lower the load onto that surface. In the case of hoisting, initiation of the lift at an inappropriate point of the vessel's movement can result in severe shock loads on the crane, which may result in failure of components, damage to the crane or, in extreme cases, toppling of the crane from its mounting. As well as damage to the crane, the crane operator may be injured or even killed. Further, the vertical acceleration of the vessel caused by wave movement may be such that the surface of the vessel comes into secondary contact with the load after lifting has commenced. This can cause severe damage to the load, the vessel, or both, and can also cause serious injury to persons on the vessel.

In the case of lowering the load, if the load contacts the surface at a point where the vessel is accelerating upwards, the load or the vessel may be damaged, and there is considerable danger to the deckhands who are preparing to receive the load.

Further difficulties are caused because ocean waves are not a perfect sine wave, but vary in height in a way that is not accurately predictable. In heavy seas it also often happens that one wave may be superimposed slightly out of phase on another, resulting in a false crest. If lifting or lowering occurs on such a false crest, secondary contact is almost certain to occur.

In order to minimize these dangers, the load should be hoisted from or lowered onto the surface at the moment when the vessel is near the crest of a major wave. In heavy seas it is almost impossible for the crane operator to make an unassisted determination of this optimum time. He is generally located in a cab on the crane, high above the surface of the vessel which is almost vertically below him. Further, he must be constantly operating the crane controls while the load is being prepared for hoisting so as to keep the hoist rope vertically positioned above the load to prevent the development of a pendulum movement of the load when it is hoisted. In addition, visibility is likely to be poor in severe sea state conditions.

As a result of the problems outlined above, there have been numerous accidents which have occurred during the transfer of suplies to offshore platforms, particularly in the North Sea, resulting in extensive property damage, personal injuries and loss of life. In order to reduce the number of these accidents, the relevant authorities have enacted regulations, governing such things as the maximum sea state that supply operations can be carried out in, and specifying the factor by which a crane must be derated according to sea state. The result of these regulations is that there are significant limitations on what can be lifted onto an offshore platform and the conditions in which the lifting operation can take place.

Various devices for determining the correct point for initiating hoisting have been described, for example in U.S. Pat. Nos. 4,098,082, 4,304,337 and 4,324,385. None of this prior art, however, addresses the problem of distinguishing between true and false crests, and between sizes of waves in the same train. Further, all the prior art referred to above is directed to the problem of unloading a vessel by a stationary crane, and does not address the different problems which arise when the reverse maneuver is to be carried out.

SUMMARY OF THE INVENTION

The above noted and other disadvantages of the prior art are overcome by providing a wave motion compensator which synchronizes the movement of the winch rope with the movement of the load without significant lag, thereby maintaining a substantially constant tension on the winch rope. There is further provided a hoist control which automatically initiates lifting or completes lowering at the optimum point for the particular sea state experienced at that time.

The present invention provides a wave motion compensator for a marine winch, in which the winch drive motor has a servo controller. The controller is actuated so as to apply a predetermined tension to the winch rope. A means for making a first and second determination of the direction of vertical motion, vertical displacement, vertical velocity and vertical acceleration of a load on the winch rope relative to the winch and for comparing these determinations is provided, and from this comparison and standard sea state data a suitable means predicts the vertical displacement, vertical velocity and vertical acceleration of the load relative to the winch at a time in advance of the time at which the prediction is made at least as lcng as the lag time of the controller and winch drive motor. The controller is actuated according to this prediction so as to effect changes in the winch speed and direction such that the motion of the winch rope substantially corresponds without significant lag to the motion of the load, thereby maintaining substantially constant tension on the winch rope.

In one embodiment, the means for actuating the control means so as to apply a predetermined tension to the winch rope is a programmed digital computer.

In the preferred embodiment, the means for making the determinations of the direction of vertical motion, vertical displacement, vertical velocity and vertical acceleration of the ship relative to the crane is a digital computer programmed to analyze data from a transducer mounted so as to measure the movement of the hoist rope.

Preferably, the means for comparing these determinations and using this comparison and standard sea state data to predict the vertical displacement, vertical velocity and vertical acceleration of the load relative to the winch is a programmed digital computer.

In another embodiment, the means for actuating the control means according to this prediction so as to effect changes in the winch speed and direction is a programmed digital computer.

The invention provides a method of wave motion compensation for a marine winch by the steps of actuating a servo-actuated control means for the winch drive motor so as to apply a predetermined tension to the winch rope, making first and second determinations of the direction of vertical motion, vertical displacement, vertical velocity and vertical acceleration of a load on the winch rope relative to the winch, comparing these determinations and using this comparison and standard sea state data to predict the position and motion of the load relative to the winch at a time in advance of the time at which the prediction is made a least as long as the lag time of the control means and winch motor. The control means is then actuated according to this prediction so as to effect changes in the winch speed and direction such that the motion of the winch rope substantially corresponds to the motion of the load, thereby maintaining substantially constant tension on the winch rope.

In one embodiment, the step of actuating the servo-actuated control means so as to apply a predetermined tension to the winch rope is carried out using a programmed digital computer.

A preferred method of carrying out the step of making first and second determinations of the direction of vertical motion, vertical displacement, vertical velocity and vertical acceleration of the load relative to the winch is by supplying a programmed digital computer with data from a transducer mounted so as to measure the movement of the hoist rope.

Preferably, the steps of comparing these determinations and using this data and standard sea state data to predict the vertical displacement, vertical velocity and vertical acceleration of the load relative to the winch is carried out using a programmed digital computer.

In another embodiment, the control means is actuated according to this prediction so as to effect changes in the winch speed and direction by means of a programmed digital computer.

The present invention further provides a marine crane hoist control, which applies a tension less than the weight of the load to be hoisted or lowered to the hoist rope while the hoist rope is connected to the load and while the load is on a vessel from which it is to be hoisted or onto which it has been lowered and which automatically maintains this tension constant as the load rises and falls with the vessel relative to the position of the crane. There is also provided means for determining data representing the direction of vertical motion, vertical displacement, vertical velocity and vertical acceleration of the vessel relative to the crane, and for comparing this data to standard sea state data to determine the optimum time for initiating lifting or completing lowering of the load. When it is determined that this optimum time has been reached, the lifting is initiated or the lowering completed automatically by electronic means.

In one embodiment, the tension is automatically applied by a winch drive motor controlled by a programmed digital computer. The winch drive motor may be a hydraulic motor or an electric motor.

In the embodiment using a hydraulic winch drive motor, the preferred means for maintaining the tension constant is a prime power driven servo controlled hydrostatic variable displacement reversible pump controlling the winch drive motor.

In the embodiment using an electric winch drive motor, the preferred means for maintaining the tension constant is an electronic means of controlling the winch motor torque output.

In another embodiment, the means for determining data representing the direction of vertical motion, vertical displacement, vertical velocity and vertical acceleration of the vessel relative to the crane is a digital computer programmed to analyze data from a transducer mounted so as to measure the movement of the hoist rope.

In one embodiment, the transducer is mounted on the hoist winch.

In another embodiment, the transducer is mounted on the winch drive shaft.

In yet another embodiment, the transducer is mounted on an idler sheave over which the hoist rope passes.

In a further embodiment, the means for determining data representing the direction of vertical motion, vertical displacement, vertical velocity and vertical acceleration of the vessel relative to the crane is a digital computer programmed to analyze data from an audio transducer mounted on the load support and directed towards the vessel.

In the preferred embodiment, the means for comparing this data to standard sea state data to determine the optimum time for initiating lifting or completing lowering of the load is a programmed digital computer.

In the preferred embodiment, the electronic means for automatically initiating such lifting or completing such lowering at the determined optimum time is a programmed digital computer.

In yet a further embodiment, the hoist control further comprises a means for prevention of the removal of the load from the supporting surface if the load exceeds the predetermined lifting capacity of the crane.

The invention provides a method of lifting a load from a vessel which is in motion relative to the lifting crane by the steps of connecting the load to the crane hoist rope, applying a tension to the hoist rope less than the weight of the load to be lifted and maintaining this tension constant as the load on the vessel rises and falls relative to the crane. While the tension is being maintained constant the direction of vertical motion, displacement, vertical velocity and vertical acceleration of the load relative to the crane are determined and compared to standard sea state data to determine the optimum time to initiate lifting of the load. When the optimum time is reached the lift is automatically initiated by electronic means.

A preferred method of carrying out the step of determining data representing the direction of vertical motion, vertical displacement, vertical velocity and vertical acceleration of the vessel relative to the crane is by supplying a programmed digital computer with data from a transducer mounted so as to measure the movement of the hoist rope.

In the preferred method, the step of comparing this data to standard sea state data to determine the optimum time to initiate lifting the load is carried out using a programmed digital computer.

The step of automatically initiating such lift at the determined optimum time by electronic means is preferably carried out using a programmed digital computer.

The invention further provides a method of lowering a load onto a vessel which is in motion relative to the lowering crane by the steps of lowering the load into the vicinity of the vessel, determining data representing the direction of vertical motion, vertical displacement, vertical velocity and vertical acceleration of the vessel relative to the load and comparing this data to standard sea state data to determine the optimum time to complete lowering of the load onto the vessel. When this optimum time is reached, the lowering of the load is automatically completed and a constant tension is maintained on the hoist rope after the load has been lowered onto the ship until the load is disengaged from the hoist rope.

The preferred method of carrying out the step of determining data representing the direction of vertical motion, vertical displacement, vertical velocity and vertical acceleration of the vessel relative to the load is by supplying a programmed digital computer with data from an audio transducer mounted on the load support and directed towards the vessel.

In the preferred method, the step of comparing this data to standard sea state data to determine the optimum time to initiate lifting the load is carried out using a programmed digital computer.

The step of automatically completing such lowering at the determined optimum time is preferably carried out using a programmed digital computer.

It is an advantage of the invention that it provides a new and improved crane hoist control and methods of lifting a load from or lowering a load onto a vessel which is in motion relative to the crane which provide for automatic lifting or lowering at the optimum time. As a result, larger loads can be lifted with safety than is possible under prior art systems. A further advantage is that loading and unloading operations may be carried out in more severe sea state conditions than is possible with previously described systems.

The above and other objects and advantages of the present invention will become more apparent from a detailed description of preferred embodiments when read in conjunction with the drawings.

BRIEF DESCRIPTION OF THE DRAWINGS

FIG. 5 is a partial sectional view of the hand controller.

FIG. 6 is a schematic view of the arrangement of the preferred embodiment used for the lowering of loads.

DESCRIPTION OF THE PREFERRED EMBODIMENT

Figure 1:
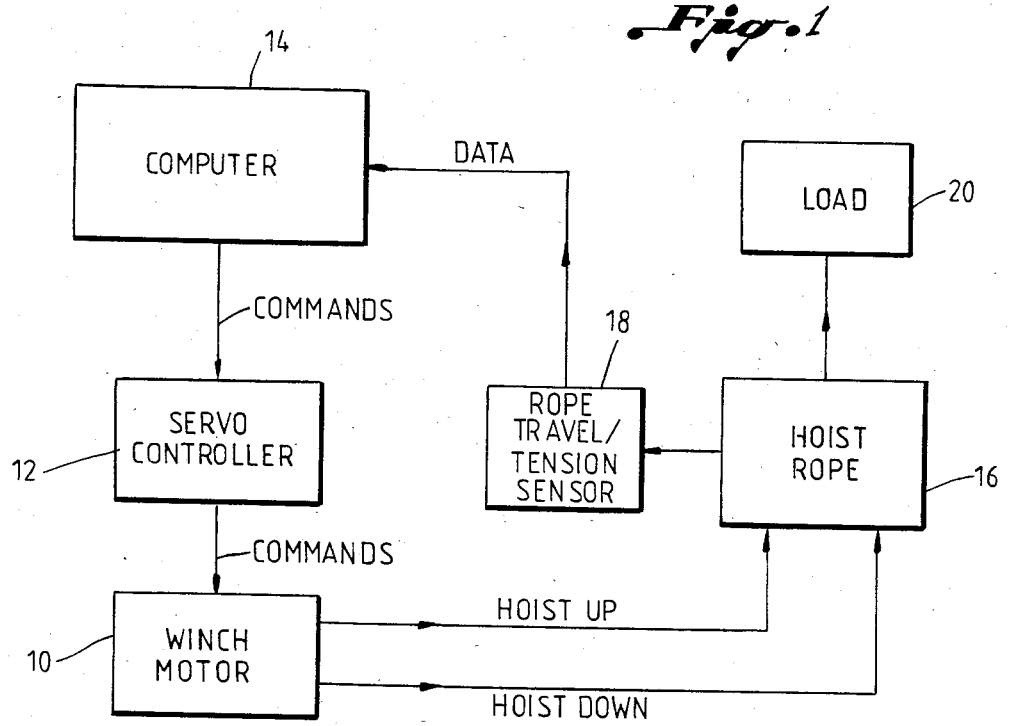
FIG. 1 is a schematic representation of the wave motion compensator.

FIG. 1 is a schematic representation of the wave motion compensator.

The winch drive motor 10 is controlled by means of a servo controller 12. In the case of a hydraulic winch drive motor the preferred servo controller is a prime power driven hydrostatic variable displacement reversible pump of a conventional type. In the case of an electric winch motor, an electronic means of controlling the winch drive motor torque output is preferably used to control the winch.

The operation of the servo controller 12 is controlled by signals from a computer 14, which is preferably a programmed digital computer using a microprocessor. The microprocessor may be selected from suitable commercially available microprocessors.

Figure 2:
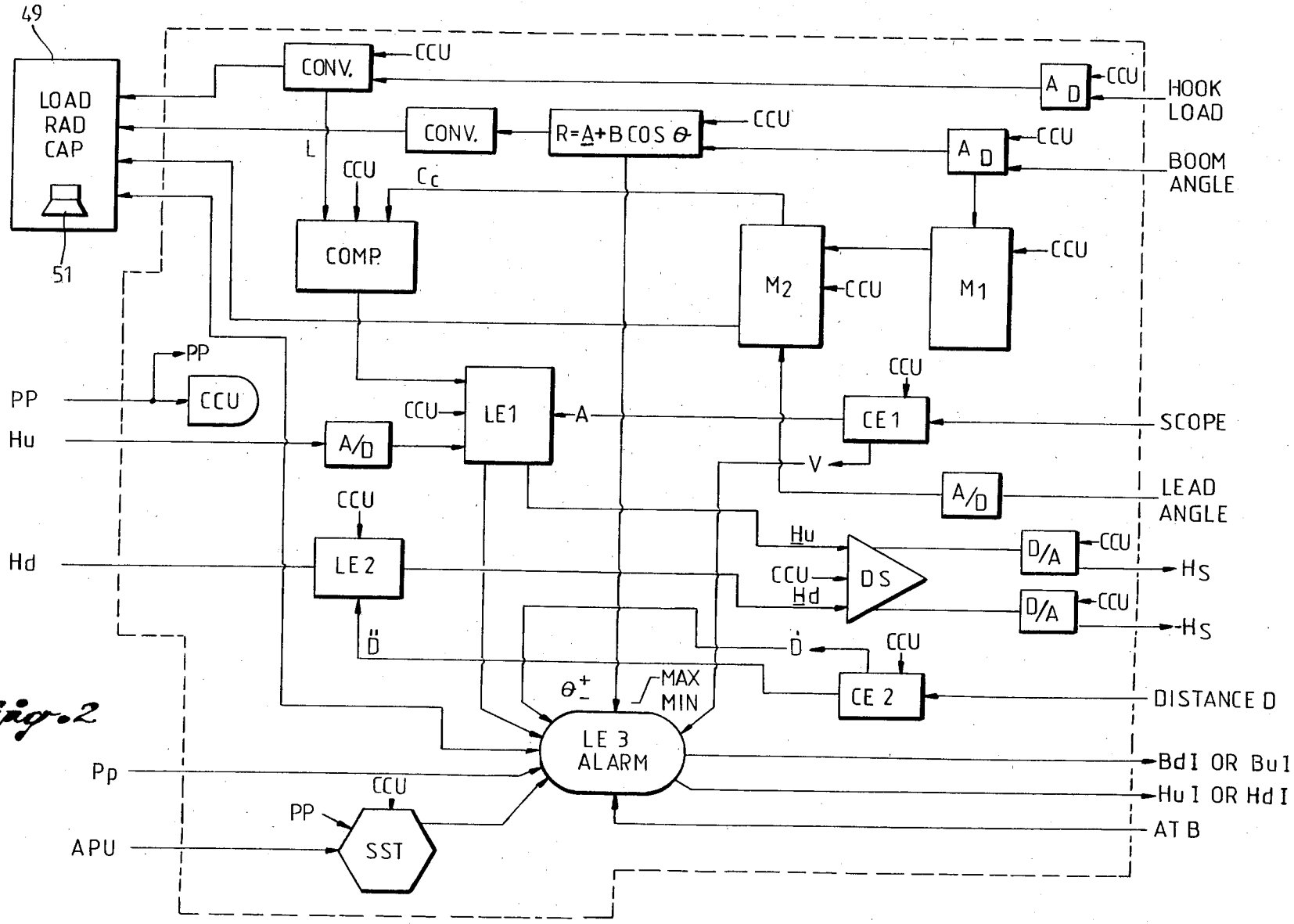
FIG. 2 is a diagrammatic representation of the operation of the programmed digital computer.

FIG. 2 shows the operation of the computer 14 in diagrammatic form. The components within the dash line rectangle represent the computative elements, which do not necessarily correspond to any particular hardward element in the computer.

The meanings of the symbols denoting these elements are as follows:

COMP is a comparator, which electronically compares one signal with another.

CONV is a converter, a digital element required to generate a data train compatible with the desired information display.

A/D is an analog/digital converter, an element of electronics used to convert an analog signal into a compatible digital data stream for further conditioning within the computer.

D/A is a digital/analog converter, an element of electronics used to convert a digital data stream into an analog signal to be used as control inputs to system actuators.

CCU is the central control unit, which comprises a group of devices to accept primary power (PP), generate the precision voltages necessary throughout the control system, generate the central timing reference and distribute both throughout the computer and control system.

Arrows marked CCU represent CCU input into the system as reference for computation or synchronization.

CE is a computative element used to convert a transducer output into an intelligible data stream for use by other computer components in logic decisions.

$M_1$ is a digital electronic memory device in which permanent data may be stored allowing the computer to be configured for a particular force producing mechanism in a specific application. In craning applications $M_1$ would retain the appropriate crane capacity data.

$M_2$ is a digital electronic memory device in which data may be stored and/or removed and replaced at the direction of the CCU.

LE is a digital electronic device of decision making capability based upon historical data.

DS is a digital electronic device to generate control signals to operate servo actuators.

SST is system self test, an interconnected set of electronic components including logic elements to sample throughout the control system, to deduce faults and failures and initiate corrective action.

The following nomenclature is used on FIG. 2

$H_u$ —Hoist up command (operator)

$\overline{H}_u$ —Hoist up command (system)

$H_d$—Hoist down command (operator)

$\overline{H}_d$—Hoist down command (system)

$H_s$—Hoist stroker signal up (volts)

$-H_s$ —Hoist stroker signal down (volts)

L—Load (pounds/kilograms)

$\theta$—Boom angle namely, the angle between the boom 32 and the horizontal (degrees)

Scope—Rope out or in (feet/meters)

V—Rope velocity (ft/sec)

A—Rope acceleration (ft/sec$^2$)

D—Distance above deck (ft)

$\ddot{D}$—Deck velocity WRT load (ft/sec)

$\dot{D}$—Deck acceleration WRT load (ft/sec$^2$)

$B_d{}^I$—Boom down command from logic element $LE_3$ $H_dI$—Hoist down command from logic element $LE_3$ $B_uI$—Boom up command from logic element $LE_3$ $H_uI$—Hoist up command from logic element $LE_3$ ATB—Anti Two-Block (a switch closure) volts Lead Angle—Load support rope out of verticality angle (degrees)

APU—Auxilliary power source

PP—Primary power $P_p$—Power plant $C_c$—Maximum hook load capacity

R—Operating radius; namely the horizontal distance from the center line of rotation of the crane 22 to the free hanging hook 36, calculated from the equation $R=A+B \cos \theta$ where A is the horizontal distance from the center line of rotation of the crane to the point of rotation of the boom, B is the length of the boom and $\theta$ is the boom angle.

The various operations of the computer are described in detail below. The present invention is not limited to any particular program, and the actual programming for each application will be different, but can be readily written by one skilled in the art.

At the commencement of the operation, the computer 14 issues a command to the servo controller 12 to operate the winch drive motor 10 so as to apply a predetermined tension to the hoist rope 16. The tension to be applied depends upon the particular application and circumstances of use, and may be preprogrammed into the computer or may be entered manually by the crane operator.

The movement of the hoist rope 16 is measured by a rope travel sensor 18. This is preferably a suitable transducer of a conventional type, which may be mounted on the winch, the winch drive shaft or on an idler sheave over which the hoist rope 16 passes. As the load 20 rises and falls relative to the winch as a result of wave motion, data representing length of rope moving past the rope travel sensor 18 per unit time is constantly relayed to the computer 14. This information, referred to as "scope" in FIG. 2, is fed into the computer. This information is processed by computative element $CE_1$ to calculate the speed of travel V of the rope, using the conventional formula $V=D/T$, where D is distance travelled and T is time. As the movement of the rope is determined by the movement of the load, the velocity of travel of the rope is proportional to the velocity of travel of the load, depending on the number of parts of line used in the hoist rope. Computative element $CE_1$ also calculates the acceleration of the rope, and therefore the acceleration of the load, by comparing one computed velocity with another slightly later in time, using the conventional formula $A=(V_2-V_1)\ /dT$, where A is the acceleration, $V_2$ is the later and $V_1$ the earlier velocity, and dT is the time interval between the two velocity measurements.

Figure 3:
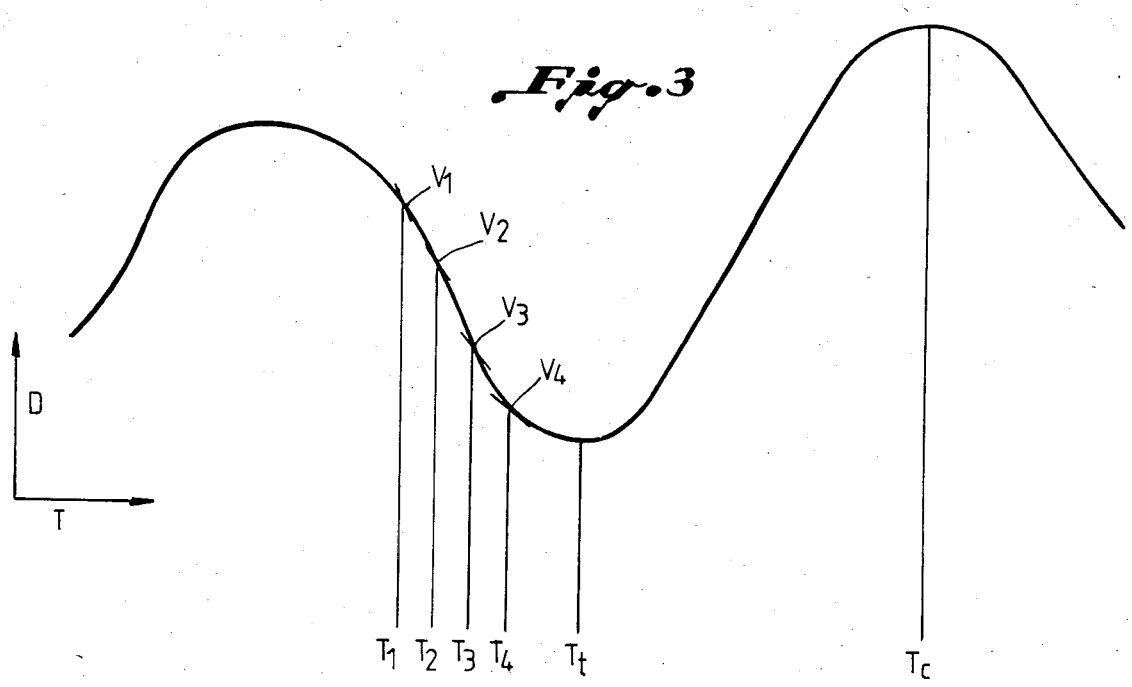
FIG. 3 is a graphic representation of the wave motion as a function of vertical distance and time.

The wave motion is represented graphically in FIG. 3 as a function of vertical distance D and time T. The velocity of motion at any time T is represented by a tangent to the curve at that point. Assuming the first velocity calculated by $CE_1$ is $V_1$ at time $T_1$, after the interval $dt=T_2-T_1$, the calculated velocity is $V_2$. $V_2$ is approximately equal to $V_1$, so that the acceleration A is very small. This indicates to the computer that the point of motion is approximately half way between a crest and a trough. As the motion approaches the trough, the rate of change of velocity, $V_3-V_2$ and $V_4-V_3$ increases and therefore A increases. The computer has been programmed with standard sea state data, in particular mean wave height and frequency. At the commencement of the operation the applicable sea state at the time of operations will have been entered by the crane operator. By comparing the rate of change of acceleration computed from the input data to the expected values for the particular sea state, the logic element $LE_1$ is able to predict the position and velocity of the motion at a point Dt in advance of the time of predicition. The length of the period Dt depends upon the rate of response of the rope travel sensor 18 and the characteristics of the computer 14, and should be at least the lag time of the servo controller 12 and the winch drive motor 10, i.e., the time between a command signal being given by the computer and the winch starting to move in response to that command. It is particularly important to be able to predict point $T_t$, the bottom of the trough, and $T_c$, the top of the crest, as the direction of motion changes at this point, so the winch must reverse direction.

Figure 4:
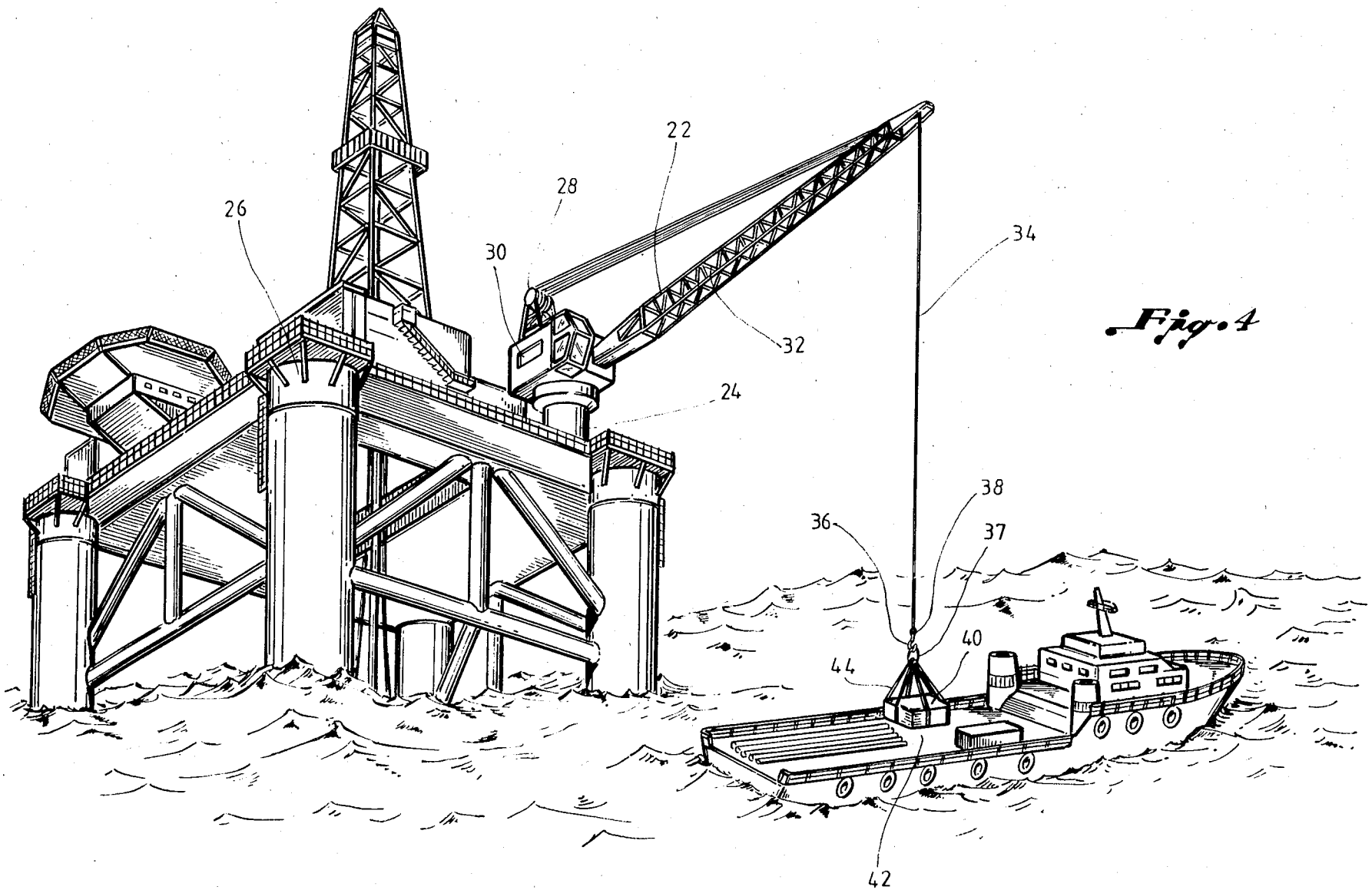
FIG. 4 is a general view of a marine crane incorporating the preferred embodiment and a ship being offloaded in accordance with the preferred method.

The above described wave motion compensator is preferably used in the crane hoist control system shown in FIG. 4.

FIG. 4 shows a marine crane 22, of a conventional type, rotatably mounted on a fixed base 24 which may be part of an offshore platform 26. The crane may include an operator's cab 28 or remote operator station, a housing for the winch machinery 30 and a movable boom 32. The winch drive motor, which may be a hydraulic or an electric motor, must be capable of high speed lifting and be of a sufficient capacity for the particular circumstances in which the crane is to operate. For the purposes of this invention, the crane should preferably have a single part hoist rope 34, capable of high speed lifting. This rope is supplied with a hook.36 and an overhaul ball 38 of suitable weight to overcome the breakaway friction of the winch and rope under all circumstances.

For the purposes of hoisting a load 40 from the deck of a supply vessel 42, the load 40 is supplied with long slings 44. These slings are fastened around the load by deckhands on the supply vessel, prior to hoisting operations, and connected to the hook 36 by a ring 37 at commencement of hoisting.

Once the slings are in place, the crane operator initiates the hoist up command by operating a hand controller of a conventional type 48, shown in FIG. 5. Preferably, this hand controller is operated by a single joystick, which, as well as providing the hoist up command, can control the up/down, right/left movements of the boom 32. In the preferred embodiment the joystick is operated by alterations in a magnetic field induced by a field winding, the alterations being measured by inductive detectors. This type of joystick is preferred as providing reliable control in extreme conditions of use.

The operation and control of the winch drive motor is shown schematically in FIG. 1 and has been described above. Information from computer 14 is displayed on display 49 which is preferably located at the operator's station. This information may be displayed in analog or digital form. The display preferably also includes a warning light 51 and/or an audible warning, to advise the operator of overload conditions.

Upon receipt of the hoist up command from the hand controller 48, the computer 14 issues a command to the servo controller 12 to operate the winch drive motor 10 so as to apply a predetermined tension to the hoist rope 16. This tension must be sufficiently larger than the weight of the overhaul ball 38 so as to overcome all residual frictional forces in the hook drive mechanism of the crane 22, but be less than the weight of the load to be lifted. In the preferred embodiment a suitable tension for the particular crane involved is calculated in advance and permanetly stored in memory for access by the computer.

The tension on the hoist rope 16 is measured by a load sensing assembly which preferably comprises a strain gauge instrumented shaft for an idler sheave over which the hoist rope 16 passes. This idler sheave is preferably mounted on the boom 32. The output from the load sensing assembly, designated HOOK LOAD in FIG. 2, is constantly monitored by the computer 14 as described below.

Once the tension is applied, it is automatically maintained by the operation of the servo controller 12 upon the winch drive motor 10. The servo controller is operated by the computer in the manner described above, so as to act as a wave motion compensator.

FIG. 6 shows the embodiment of the invention used for lowering of loads onto the surface of a vessel from a relatively stationary crane. The relative distance Dv-c of the deck of the vessel 42 and the crane is measured by use of a distance measurement transducer 50, which is preferably an audio transducer of a conventional type mounted on the load support 52. The signals from this distance measurement transducer are fed into computative element CE 2 of the computer, which calculates the movement and acceleration of the surface of the vessel relative to the load.

Prior to installation, information relating to standard sea state conditions, published by the relevant official agency for the area of the world in which the crane 22 is operating, is stored in the permanent memory $M_1$ of the computer 14. This information includes trough to crest height and frequency of waves for the standard sea state conditions.

In the lifting mode, the information on distance, velocity, acceleration and direction of travel of the load relative to the crane is fed into memory unit $M_2$ of the computer 14. This information is accessed by logic element $LE_1$. This is programmed to detect the first point at which the velocity V reaches 0 after a period of negative velocity. At this point the vessel 42 is at the bottom of a wave trough. Logic element $LE_1$ then waits until the next zero velocity is predicted. That zero velocity corresponds to the point at which the vessel 42 is at the crest of the next wave. The computer 14 computes the vertical distance between the two points. Logic element $LE_1$ then compares this distance to the standard trough to crest height information stored in permanent memory $M_1$, the relevant sea conditions for this particular operation having been previously determined by the winching supervisor and entered into the control system by the crane operator. Logic element $LE_1$ will only initiate lift at the time of prediction of the point of approaching zero velocity following a period of positive velocity, and will only do so if the vertical distance between this predicted point and the previous zero velocity corresponds to the programmed minimum distance stored in the permanent memory $M_1$. Lift should preferably be commenced before the point of zero velocity is reached so that the load has an upwards vertical velocity which assists the lifting process.

When these conditions are fulfilled, the computer, through signal generator DS, signals the servo controller 12, which causes the winch drive motor 10 to wind in the hoist rope 16 at a programmed velocity compatible with load acceleration limits.

In the lowering mode, the optimum time for completing lowering is calculated in a similar manner. The distance measurement from distance measurement transducer 50, indicated on FIG. 2 as DISTANCE, is fed into computative element $CE_2$ which calculates the velocity and acceleration of the vessel relative to the load in the same manner as $CE_1$ processes the SCOPE data, as described above. This information is accessed by logic element $LE_2$, which operates in a similar manner to $LE_1$, as described above. However, in the case of lowering, logic element waits until it predicts that the point of zero velocity has passed and the velocity has become negative before initiating lowering. Lowering should preferably be completed just after the vessel reaches the crest of a significant wave so that the downward motion of the load support surface of the vessel reduces the impact velocity of the load.

In the preferred embodiment, the computer 14 is also programmed to compare the actual tension on the hoist rope 16 at any moment with a predetermined maximum lift capacity of the crane 22 for that particular sea state condition. The tension on the rope is measured by the load sensing assembly. The output from the load sensing assembly, HOOK LOAD in FIG. 2, is fed through analog/digital converter A/D into converter element CONV. This generates a signal compatible with the display 49 and transmits the signal to that display. It also transmits the hook load information L in suitable form to comparator element COMP, which compares the information L to the precalculated maximum hook load capacity Cc. Capacity Cc is derived by modifying the nominal maximum capacity of the crane 22 to allow for derating factors such as wind, sea state conditions, lift rope lead angle, power plant and hydraulic system anomilies. Capacity Cc is calculated by logic element $LE_1$ from data stored in memory element $M_1$ and stored during operations in dynamic memory element $M_2$, from which it is accessed by comparator COMP. The output signal, positive if Cc is greater than L, zero if Cc is equal to L and negative if Cc is less than L, is input to logic element $LE_3$. If Cc is equal to or less than L, logic element $LE_3$ sends signals HuI, which inhibits hoisting, Bd I, which inhibits lowering of the boom, and an alarm signal which activates the alarm on display 49.

In a similar manner, safety limits for the boom angle and lead rope lift angle may be programmed in, and lifting will be inhibited and a warning sounded if these limits are exceeded.

Additional advantages and modification will be readily apparent to those skilled in the art. The invention in its broader aspects is therefore not limited to the specific details, representative apparatus or the illustrative example shown and described. Accordingly, departures may be made from the detail without departing from the spirit or scope of the disclosed general inventive concept.

What is claimed is:

1. A wave motion compensator for a marine winch, comprising:

control means for controlling the speed and direction of the winch drive motor, means for actuating the control means so as to apply a predetermined tension to the winch rope, means for making a first determination of the direction of vertical motion, vertical displacement, vertical velocity and vertical acceleration of a load on the winch rope relative to the winch, means for making a second determination of the direction of vertical motion, vertical displacement, vertical velocity and vertical acceleration of the load on the winch rope relative to the winch, said second determination being at a later time than said first determination, means of comparing the results of said first and second determinations, means for using this comparison and standard sea state data to predict the vertical displacement, vertical velocity and vertical acceleration of the load relative to the winch at a time in advance of the time at which the predicition is made at least as long as the lag time of the control means and winch drive motor, and means for actuating the control means according to this prediction so as to effect changes in the winch speed and direction such that the motion of the winch rope substantially corresponds without significant lag to the motion of the load, thereby maintaining substantially constant tension on the winch rope.

2. A wave motion compensator for a marine winch as defined in claim 1, wherein the means for actuating the control means so as to apply a predetermined tension to the winch rope is a programmed digital computer.

3. A wave motion compensator for a marine winch as defined in claim 1, wherein the means for making the first and second determinations of the direction of vertical motion, vertical displacement, vertical velocity and vertical acceleration of the load relative to the winch is a digital computer programmed to analyze data from a transducer mounted so as to measure the movement of the hoist rope.

4. A wave motion compensator for a marine winch as defined in claim 1, wherein the means for comparing the results of said first and second determination is a programmed digital computer.

5. A wave motion compensator for a marine winch as defined in claim 1, wherein the means for using this comparison and standard sea state data to predict the vertical displacement, vertical velocity and vertical acceleration of the load relative to the winch is a programmed digital computer.

6. A wave motion compensator for a marine winch as defined in claim 1, wherein the means for actuating the control means according to this prediction so as to effect changes in the winch speed and direction is a programmed digital computer.

7. A method of wave motion compensation for a marine winch comprising:

actuating a control means for the winch drive motor so as to apply a predetermined tension to the winch rope, making a first determination of the direction of vertical motion, vertical displacement, vertical velocity and vertical acceleration of a load on the winch rope relative to the winch, making a second determination of the direction of vertical motion, vertical displacement, vertical velocity and vertical acceleration of the load on the winch rope relative to the winch, said second determination being at a later time than said first determination, comparing the results of said first and second determinations, using this comparison and standard sea state data to predict the vertical displacement, vertical velocity and vertical acceleration of the load relative to the winch at a time in advance of the time at which the prediction is made at least as long as the lag time of the control means and winch drive motor and, actuating the control means according to this prediction so as to effect changes in the winch speed and direction such that the motion of the winch rope substantially corresponds to the motion of the load, thereby maintaining substantially constant tension on the winch rope.

8. A method of wave-motion compensation for a marine winch as described in claim 7, wherein the step of actuating a control means for the winch drive motor so as to apply a predetermined tension to the winch rope is carried out using a programmed digital computer.

9. A method of wave motion compensation for a marine winch as described in claim 7, wherein the step of making said first and second determinations of the direction of vertical motion, vertical displacement, vertical velocity and vertical acceleration of the load relative to the winch is carried out by supplying a programmed digital computer with data from a transducer mounted so as to measure the movement of the hoist rope.

10. A method of wave motion compensation for a marine winch as described in claim 7, wherein the step of comparing the results of said first and second determinations is carried out using a programmed digital computer.

11. A method of wave motion compensation for a marine winch as described in claim 7, wherein the step of using this comparison and standard sea state data to predict the vertical displacement, vertical velocity and vertical acceleration of the load relative to the winch is carried out using a programmed digital computer.

12. A method of wave motion compensation for a marine winch as described in claim 7, wherein the step of actuating the control means according to this prediction so as to effect changes in the winch speed and direction is a programmed digital computer.

13. A hoist control for a marine crane, comprising:

means for applying a tension less than the weight of a load to be hoisted or lowered to the hoist rope while the hoist rope is connected to the load and while the load is on a vessel from which it is to be hoisted or onto which it has been lowered;

means for maintaining such tension constant as the load while on the vessel rises and falls with the vessel relative to the position of the crane;

means for determining data representing the direction of vertical motion, vertical displacement, vertical velocity and vertical acceleration of the vessel relative to the crane;

means for comparing this data to standard sea state data to determine the optimum time for initiating lifting or completing lowering of the load; and electronic means for automatically initiating such lifting or completing such lowering at the determined optimum time.

14. A host control for a marine crane as defined in claim 13, wherein the means for maintaining such tension constant is a computer controlled wave motion compensator.

15. A hoist control for a marine crane as defined in claim 13, wherein the means for determining data representing the direction of vertical motion, vertical displacement, vertical velocity and vertical acceleration of the vessel relative to the crane is a digital computer programmed to analyze data from an audio transducer mounted on the load support and directed towards the vessel.

16. A hoist control for a marine crane as defined in claim 13, wherein the means for comparing this data to standard sea state data to determine the optimum time for initiating lifting or completing lowering of the load is a programmed digital computer.

17. A hoist control for a marine crane as defined in claim 13, wherein the electronic means for automatically initiating such lifting or completing such lowering at the determined optimum time is a programmed digital computer.

18. A hoist control for a marine crane as defined in claim 13, further comprising a means for preventing the removal of the load from the supporting surface if the load exceeds the predetermined lifting capacity of the crane.

19. A hoist control for a marine crane as defined in claim 13, wherein the means for determining data representing the direction of vertical motion, vertical displacement, vertical velocity and vertical acceleration of the vessel relative to the crane is a digital computer programmed to analyze data from a transducer mounted so as to measure the movement of the hoist rope.

20. A hoist control for a marine crane as defined in claim 19, wherein the transducer is mounted on the hoist winch.

21. A hoist control for a marine crane as defined in claim 19 wherein the transducer is mounted on the winch drive shaft.

22. A hoist control for a marine crane as defined in claim 19 wherein the transducer is mounted on an idler sheave over which the hoist rope passes.

23. A hoist control for a marine crane as defined in claim 13, wherein the means for aplying a tension less than the weight of a load to be hoisted or lowered to the hoist rope while the hoist rope is connected to the load and while the load is on a vessel from which it is to be hoisted or onto which it has been lowered is a winch drive motor controlled by a servo-actuated controller which is controlled by a programmed digital computer.

24. A hoist control for a marine crane as defined in claim 23, wherein the winch drive motor is a hydraulic motor.

25. A hoist control for a marine crane as defined in claim 24, wherein the means for maintaining such tension constant is a prime power driven servo controlled hydrostatic variable displacement reversible pump controlling the winch drive motor.

26. A hoist control for a marine crane as defined in claim 23, wherein the winch drive motor is an electric motor.

27. A hoist control for a marine crane as defined in claim 26, wherein the means for maintaining such tension constant is an electronic means of controlling the winch drive motor torque output.

28. A method of lifting a load from a vessel which is in motion relative to the lifting crane, comprising:

connecting the load to the crane hoist rope;

applying a tension to the hoist rope less than the weight of the load to be lifted;

maintaining this tension constant as the load on the vessel rises and falls relative to the crane;

determining data representing the direction of vertical motion, vertical displacement, vertical velocity and vertical acceleration of the load relative to the crane;

comparing this data to standard sea state data to determine the optimum time to initiate lifting of the load; and automatically initiating such lift at the determined optimum time by electronic means.

29. A method of lifting a load from a vessel which is in motion relative to the lifting crane as defined in claim 28, wherein the step of determining data representing the direction of vertical motion, vertical displacement, vertical velocity and vertical acceleration of the load relative to the crane is carried out by supplying a programmed digital computer with data from a transducer mounted so as to measure the movement of the hoist rope.

30. A method of lifting a load from a vessel which is in motion relative to the lifting crane as defined in claim 28, wherein the step of comparing this data to standard sea state data to determine the optimum time to initiate lifting of the load is carried out using a programmed digital computer.

31. A method of lifting a load from a vessel which is in motion relative to the lifting crane as defined in claim 28, wherein the step of automatically initiating such lift at the determined optimum time by electronic means is carried out using a programmed digital computer.

32. A method of lowering a load onto a vessel which is in motion relative to the lowering crane, comprising:

lowering the load into the vicinity of the vessel;

determining data representing the direction of vertical motion, vertical displacement, vertical velocity and vertical acceleration of the vessel relative to the load;

comparing this data to standard sea state data to determine the optimum time to complete lowering of the load onto the vessel;

automatically completing such lowering at the determined optimum time;

maintaining a constant tension on the hoist rope after the load has been lowered onto the vessel until the load is disengaged from the hoist rope.

33. A method of lowering a load onto a vessel which is in motion relative to the lowering crane as defined in claim 32, wherein the step of determining data representing the direction of vertical motion, vertical displacement, vertical velocity and vertical acceleration of the vessel relative to the load is carried out by supplying a programmed digital computer with data from an audio transducer mounted on the load support and directed towards the vessel.

34. A method of lowering a load onto a vessel which is in motion relative to the lowering crane as defined in claim 32, wherein the step of comparing this data concerning the relative motion of the vessel and the load to standard sea state data to determine the optimum time to complete lowering of the load onto the vessel is carried out using a programmed digital computer.

35. A method of lowering a load onto a vessel which is in motion relative to the lowering crane as defined in claim 32, wherein the step of automatically completing such lowering at the determined optimum time is carried out using a programmed digital computer.

* * * * *

UNITED STATES PATENT AND TRADEMARK OFFICE

CERTIFICATE OF CORRECTION

PATENT NO. : 4,547,857

DATED : October 15, 1985

INVENTOR(S) : George H. Alexander

It is certified that error appears in the above-identified patent and that said Letters Patent is hereby corrected as shown below:

Column 2, line 31, delete "suplies" and insert --supplies--.

Column 3, line 47, delete "a" and insert --at--.

Column 6, line 43, delete "hardward" and insert --hardware--.

Column 7, line 27, delete "$\underline{-H}_s$" and insert -- $-H_s$ --;

Column 7, line 36, delete "$\ddot{D}$" and insert --$\dot{D}$--;

Column 7, line 37, delete "$\dot{D}$" and insert --$\ddot{D}$--;

Column 7, line 54, delete "A" and insert --$\underline{A}$--, both occurrences.

UNITED STATES PATENT AND TRADEMARK OFFICE

CERTIFICATE OF CORRECTION

PATENT NO. : 4,547,857 Page 2 of 2

DATED : October 15, 1985

INVENTOR(S) : George H. Alexander

It is certified that error appears in the above-identified patent and that said Letters Patent is hereby corrected as shown below:

Column 8, line 48, delete "predicition" and insert --prediction--.

Column 11, line 53, delete "predicition" and insert --prediction--.

Column 13, line 34, delete "host" and insert --hoist--.

Column 14, line 11, delete "aplying" and insert --applying--.

Signed and Sealed this

Twentieth Day of May 1986

[SEAL]

Attest:

DONALD J. QUIGG

Attesting Officer

Commissioner of Patents and Trademarks